US009108438B2

(12) United States Patent
Kuwana et al.

(10) Patent No.: US 9,108,438 B2
(45) Date of Patent: Aug. 18, 2015

(54) TREATMENT LIQUID APPLICATION APPARATUS

(71) Applicants: Kohji Kuwana, Ibaraki (JP); Hironori Numata, Ibaraki (JP)

(72) Inventors: Kohji Kuwana, Ibaraki (JP); Hironori Numata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/324,562

(22) Filed: Jul. 7, 2014

(65) Prior Publication Data

US 2015/0015636 A1 Jan. 15, 2015

(30) Foreign Application Priority Data

Jul. 12, 2013 (JP) ..... 2013-146911

(51) Int. Cl.

| | |
|---|---|
| ***B05C 11/00*** | (2006.01) |
| ***B41J 2/01*** | (2006.01) |
| ***B41J 11/00*** | (2006.01) |
| ***B41J 15/16*** | (2006.01) |

(52) U.S. Cl.

CPC ..... *B41J 11/0015* (2013.01); *B41J 15/165* (2013.01)

(58) Field of Classification Search

CPC ..... B41J 11/0015

See application file for complete search history.

(56) References Cited

U.S. PATENT DOCUMENTS

| | | | | |
|---|---|---|---|---|
| 2009/0092742 | A1* | 4/2009 | Teramoto et al. | 427/9 |
| 2009/0269119 | A1* | 10/2009 | Hatada et al. | 400/618 |
| 2011/0220017 | A1* | 9/2011 | Kitaoka et al. | 118/110 |
| 2012/0267468 | A1* | 10/2012 | Shiode | 242/419.8 |
| 2013/0026283 | A1* | 1/2013 | Kikuchi et al. | 242/563 |
| 2013/0106976 | A1* | 5/2013 | Chu et al. | 348/14.02 |
| 2013/0135370 | A1* | 5/2013 | Oba et al. | 347/9 |

FOREIGN PATENT DOCUMENTS

| | | |
|---|---|---|
| JP | 2002-096452 | 4/2002 |
| JP | 2002-103583 | 4/2002 |
| JP | 2014-024224 | 2/2014 |

* cited by examiner

*Primary Examiner* — Shelby Fidler
(74) *Attorney, Agent, or Firm* — Duft Bornsen & Fettig LLP

(57) ABSTRACT

A treatment liquid application apparatus including an application roller for applying treatment liquid; a press roller for pressing against the application roller an elongated recording medium which is placed between the press roller and the application roller; and a conveyance roller located downstream relative to the application roller on a conveyance path of the recording medium and conveying the recording medium is disclosed. The apparatus includes a control unit for causing the press roller to be pressed against the application roller when a value related to a conveyance amount of the recording medium conveyed by the conveyance roller from a re-start of conveyance exceeds a value corresponding to a slack amount of the recording medium which occurs in an upstream side of the conveyance roller at a stopping of conveyance.

6 Claims, 12 Drawing Sheets

TREATMENT LIQUID APPLICATION APPARATUS

CROSS-REFERENCE TO RELATED APPLICATION

This patent application is based on and claims priority pursuant to 35 U.S.C. §119(a) to Japanese Patent Application No. 2013-146911, filed on Jul. 12, 2013 in the Japan Patent Office, the entire disclosure of which is hereby incorporated by reference herein.

BACKGROUND OF THE INVENTION

1. Field of the Invention

The disclosures herein generally relate to a treatment liquid application apparatus.

2. Description of the Related Art

Image recording of an inkjet method is becoming increasingly popular these days because of its advantage that colorization can be easily realized, in addition to its advantages of low noise and low running cost. But, when an image is formed on a recording medium which is a non-manufacturer-specified paper, problems related to initial image quality such as image blur, image concentration change, color tone change, image show-through, etc., occur. In addition, problems related to robustness of images such as water resistance, weather resistance, etc., occur.

On the other hand, in the Patent Document 1 and the Patent Document 2, for example, configurations are proposed in which treatment liquid that has a function to cause the ink to aggregate is applied to a recording medium before the process of ejecting ink droplets onto the recording medium.

In the configurations disclosed in Patent Document 1 and Patent Document 2, however, it is assumed that a cut sheet is used as a recording medium, and the disclosures disclosed in Patent Document 1 and Patent Document 2 do not include a configuration in which treatment liquid is applied to an elongated recording medium such as a continuous paper.

In the meantime, in the case of applying treatment liquid on the elongated recording medium, it is essential to take into account a problem of slack of the recording medium. The slack occurs at a stopping of conveyance of the recording medium.

Slack of an elongated recording medium is a phenomenon which is caused, when a roller including a driving source is stopped, by a roller (which does not include a driving source) which is located in the upstream side with respect to the roller including the driving source, and continues the rotation because of inertia.

Here, if the conveyance starts without removing the slack, the result is that a strong enough tension is not provided for the recording medium at the time of re-start. And, in this situation, if the recording medium is pressed onto an application roller in order to apply treatment liquid to the recording medium, the recording medium sticks to the application roller in the case where the viscosity of the treatment liquid is high or the recording medium is thin. As a result, a failure, such as a failure in which the recording medium gets rolled around the application roller, may happen.

For the above reasons, in the case where the treatment liquid is applied to the elongated recording medium, it is desirable that the recording medium is controlled in such a way to be pressed onto the application roller after an appropriate tension is applied to the recording medium.

[Patent Document 1] Japanese Patent Application Publication No. 2002-096452

[Patent Document 2] Japanese Patent Application Publication No. 2002-103583

SUMMARY OF THE INVENTION

In one aspect, it is an object to prevent a failure which is caused by the slack of the recording medium in the treatment liquid application apparatus configured to apply treatment liquid to the elongated recording medium.

According to an embodiment of the present invention, the treatment liquid application apparatus includes a first application roller configured to apply treatment liquid; a first press roller configured to press against the first application roller an elongated recording medium which is placed between the first press roller and the first application roller; a conveyance roller located downstream relative to the first application roller on a conveyance path of the recording medium and configured to convey the recording medium; an obtaining unit configured to obtain a first slack amount of the recording medium which is created on an upstream side of the conveyance roller at a stopping of conveyance of the recording medium by the conveyance roller; a conveyance amount calculation unit configured to calculate a value related to a conveyance amount of the recording medium conveyed by the conveyance roller from a re-start of conveyance; a detection unit configured to detect that the value related to the conveyance amount from the re-start of conveyance of the recording medium calculated by the conveyance amount calculation unit exceeds a value corresponding to the first slack amount of the recording medium; and a control unit configured to cause the first press roller to be pressed against the first application roller upon detection by the detection unit that the value related to the conveyance amount of the recording medium exceeds the value corresponding to the first slack amount of the recording medium.

According to an aspect, a failure which is caused by the slack of the recording medium in the treatment liquid application apparatus configured to apply treatment liquid to the elongated recording medium can be prevented.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

Figure 1:
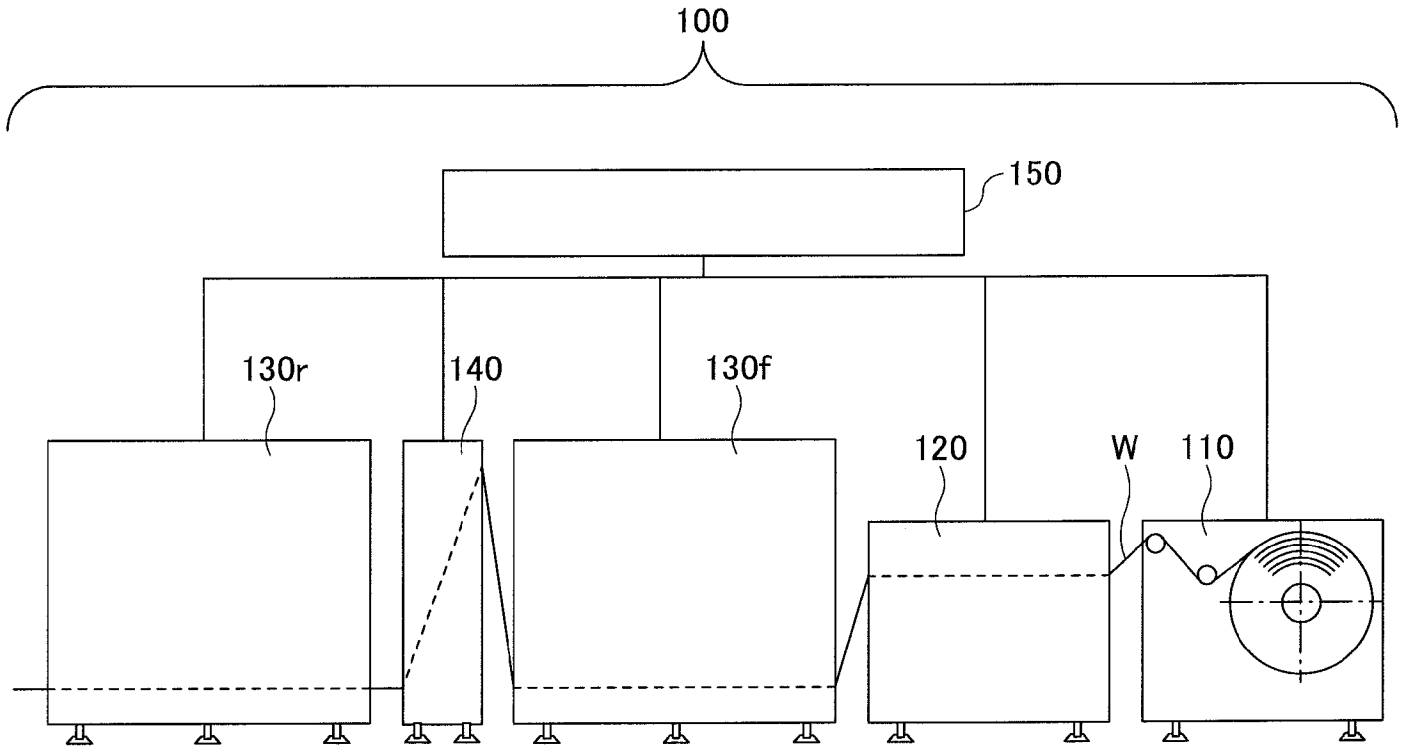
FIG. 1 is a drawing illustrating a configuration example of an entire image forming system including a treatment liquid application apparatus according to an embodiment of the present invention.

In the following, embodiments of the present invention will be described with reference to the accompanying drawings. It should be noted that configuration elements which include substantially the same functional configurations in the present specification and the drawings are assigned the same reference numerals and the duplicated description is omitted.

The First Embodiment

1. Entire Configuration of an Image Forming System

First, the entire configuration of the image forming system including a treatment liquid application apparatus of the embodiment of the present invention is described. FIG. 1 is a drawing illustrating a configuration example of an entire image forming system 100 including a treatment liquid application apparatus 120 according to an embodiment of the present invention.

As shown in FIG. 1, the image forming system 100 includes a paper feeding apparatus 110, a treatment liquid application apparatus 120, an inkjet printers 130*f* and 130*r*, a reverse apparatus 140 and a print control apparatus 150.

The elongated recording medium W such as a continuous paper which is fed out from the paper feeding apparatus 110 is first fed into the treatment liquid application apparatus 120. In the treatment liquid application apparatus 120, an application process is performed on each of the front and the rear surfaces, in which treatment liquid which aggregates ink is applied.

The recording medium W for which the application process is performed in the treatment liquid application apparatus 120 is then fed into the inkjet printer 130*f*. In the inkjet printer 130*f*, an image forming process to form an image is performed by ejecting ink droplets onto the front surface of the recording medium W.

The recording medium for the front surface of which the image forming process has been performed is, after the front and the rear surfaces are reversed by the reverse apparatus 140, fed into the inkjet printer 130*r*. In the inkjet printer 130*r*, an image forming process to form an image is performed by ejecting ink droplets onto the rear surface of the recording medium W.

In this way, the recording medium W, for each of the front and the rear surfaces of which the image forming process is performed, is fed into an after-treatment processing apparatus and a predetermined aftertreatment is performed.

It should be noted that each of the processes of the paper feeding apparatus 110, the treatment liquid application apparatus 120, the inkjet printers 130*f* and 130*r* and the reverse apparatus 140 are managed by the print control apparatus 150.

2. Configuration of the Treatment Liquid Application Apparatus 120

Figure 2:
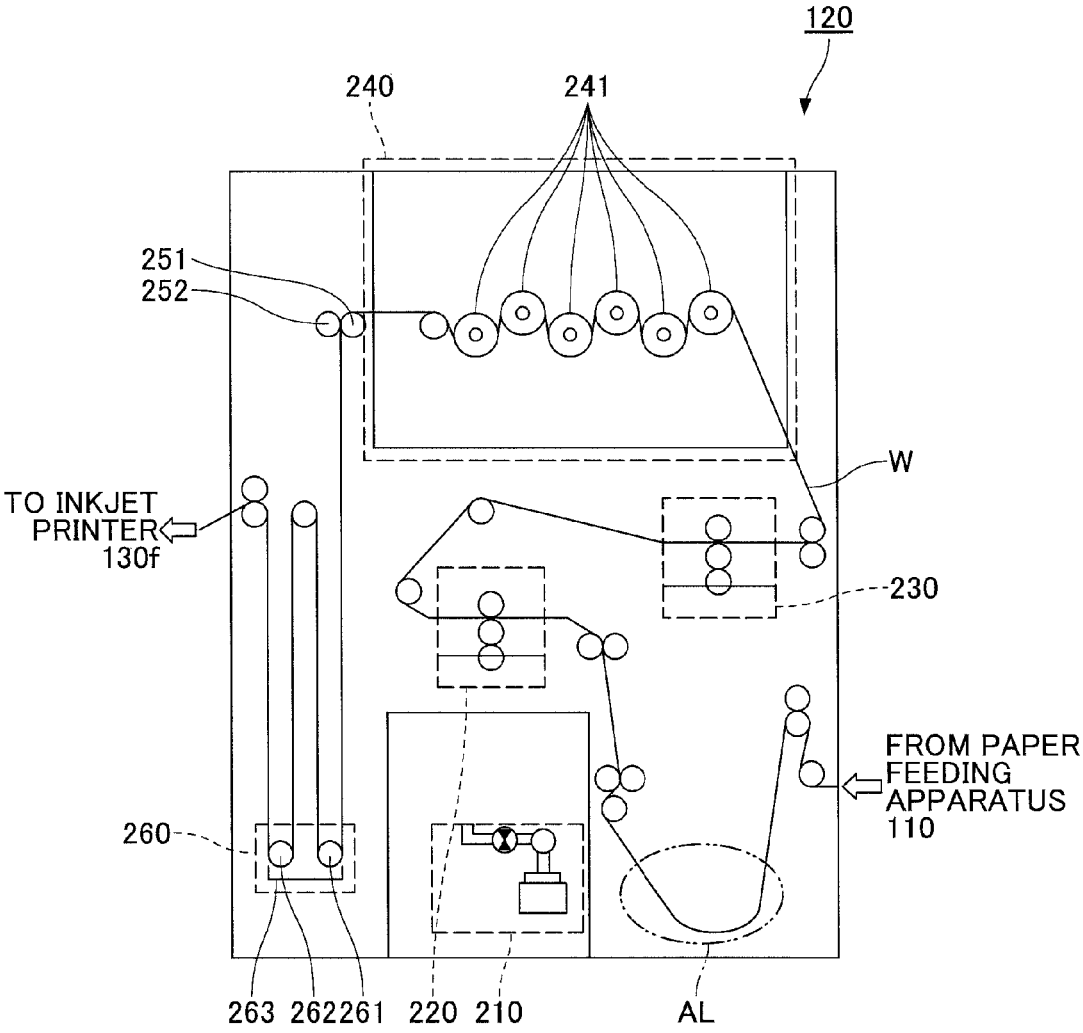
FIG. 2 is a drawing illustrating an example of a hardware configuration of the treatment liquid application apparatus according to an embodiment of the present invention.

Next, the hardware configuration of the treatment liquid application apparatus 120 will be described. FIG. 2 is a drawing illustrating an example of a hardware configuration of the treatment liquid application apparatus 120.

As shown in FIG. 2, in the treatment liquid application apparatus 120, a plurality of guide rollers are placed forming a conveyance path of the recording medium W.

The recording medium W which is fed out from the paper feeding apparatus 110 and conveyed into the conveyance path of the treatment liquid application apparatus 120 first forms an air loop (AL). The amount of slack of the formed air loop (AL) is measured by an optical sensor (not shown) and is controlled to be constant.

After passing the air loop (AL), the recording medium W sequentially passes a rear surface treatment liquid application unit 220 which applies the treatment liquid on the rear surface and a front surface treatment liquid application unit 230 which applies the treatment liquid on the front surface. As a result, the treatment liquid is applied to each of the front surface and the rear surface.

It should be noted that it is assumed that between the air loop (AL) and the rear surface treatment liquid application unit 220, a sensor for monitoring the tension applied to the recording medium and a tension controller which adjusts the tension according to the output of the sensor are provided.

To each of the rear surface treatment liquid application unit 220 and the front surface treatment liquid application unit 230, treatment liquid is provided by the treatment liquid supply unit 210. Note that the detailed configurations of the treatment liquid application and the treatment liquid supply unit will be described later.

After passing the front surface treatment liquid application unit 230, the recording medium is conveyed through the treatment liquid drying unit 240 including multiple heat rolls 241 which do not include driving sources such as motors. With this treatment liquid drying unit 240, the treatment liquid applied to each of the front and rear surfaces of the recording medium W is dried and fixed to each of the front and the rear surfaces. It should be noted that the multiple heat rolls 241 in the treatment liquid drying unit 240 are arranged alternately up and down with respect to the conveyance direction of the recording medium W. With this arrangement, the recording medium W is conveyed while being pressed onto the heat rolls 241 and forming a shape of W.

After passing through the treatment liquid drying unit 240, the recording medium W passes between a conveyance roller 251 which is driven to rotate by a driving source such as a motor and conveyance nip rollers 252. The conveyance roller 251 and the conveyance nip rollers 252 are located in the downstream side of the rear surface treatment liquid application unit 220, the front surface treatment liquid application unit 230 and the treatment liquid drying unit 240 that are arranged on the conveyance path of the recording medium W, to convey the recording medium W. The multiple number of conveyance nip rollers 252 are arranged in the axis direction of the conveyance roller 251 and are pressed onto the conveyance roller 251 by springs (not shown).

After passing between the conveyance roller 251 and the conveyance nip rollers 252, the recording medium W is conveyed to a dancer unit 260. The dancer unit 260 includes rotation-free dancer rollers 261 and 262. The recording medium W is rolled around the dancer rollers 261 and 262, and a guide roller which is arranged between the dancer rollers 261 and 262, in a shape of W. The dancer unit 260 further includes a movable frame 263. The dancer rollers 261 and 262 are rotation-freely attached to the movable frame 263. It should be noted that the dancer unit 260 is suspended by the recording medium W.

The dancer unit 260 is configured to be movable along the direction of gravitational force. The position of the dancer unit 260 is adjusted by controlling the driving source of the conveyance roller 251 according to the position of the dancer unit 260 detected by a position detection unit (not shown).

After passing through the dancer unit 260, the recording medium W is fed into the inkjet printer 130*f*.

3. Detailed Configurations of the Treatment Liquid Application Unit and the Treatment Liquid Supply Unit Next, detailed configurations of the treatment liquid application unit and the treatment liquid supply unit will be described. As described above, the treatment liquid application apparatus 120 includes the front surface treatment liquid application unit 230 and the rear surface treatment liquid application unit 220, both of which include the same configuration. Therefore, here, only the front surface treatment liquid application unit 230 will be described.

Figure 3:
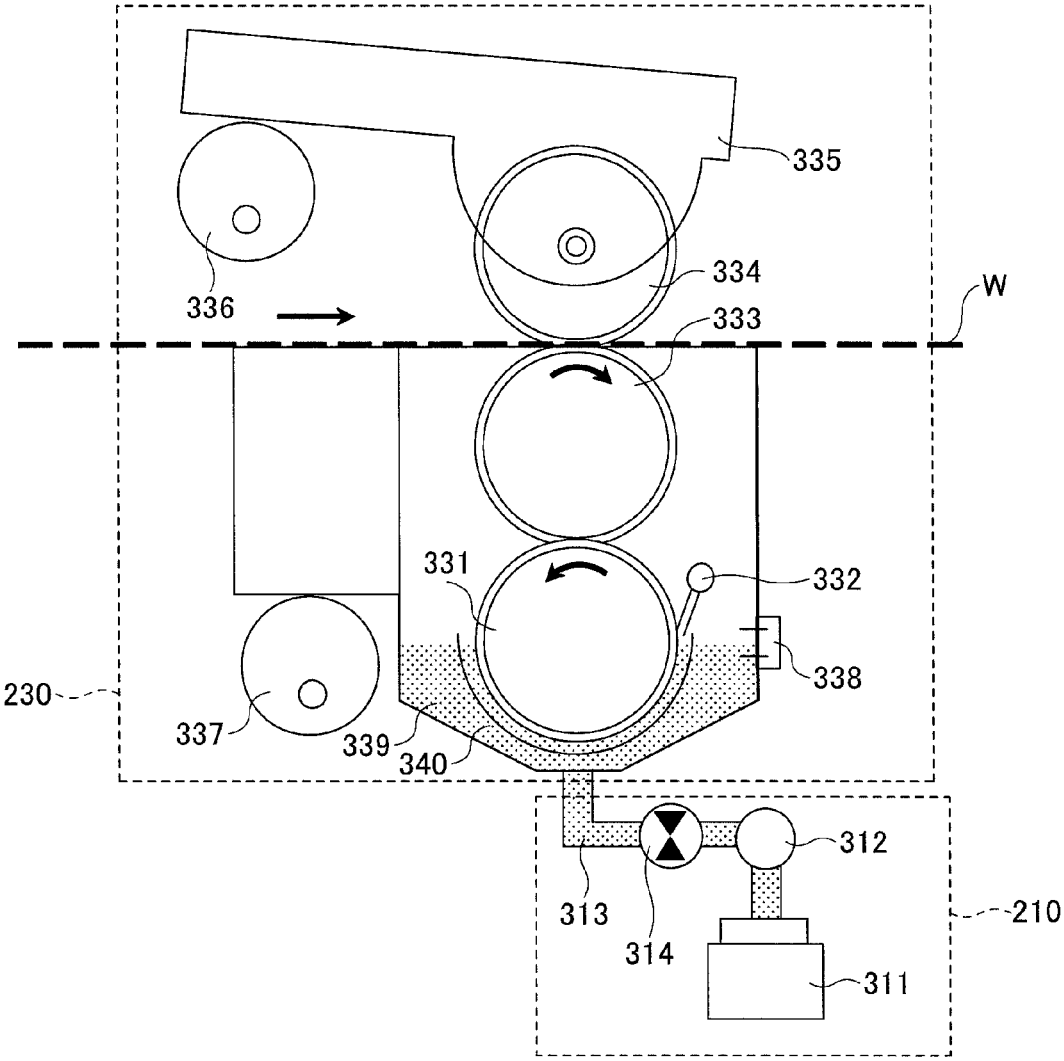
FIG. 3 is a drawing illustrating a configuration example of the surface treatment liquid application unit and a treatment liquid supply unit of the treatment liquid application apparatus according to an embodiment of the present invention.

FIG. 3 is a drawing illustrating a detailed configuration of the front surface treatment liquid application unit 230 and a detailed configuration of the treatment liquid supply unit 210. As shown in FIG. 3, the treatment liquid supply unit 210 is connected to the front surface treatment liquid application unit 230 and supplies the treatment liquid to the front surface treatment liquid application unit 230. The front surface treatment liquid application unit 230 applies the treatment liquid supplied by the treatment liquid supply unit 210 to the recording medium W.

First, the treatment liquid supply unit 210 is described. Treatment liquid 340 stored in a cartridge 311 of the treatment liquid supply unit 210 is pumped up by a pump 312 and supplied to a supply pan 339 via a supply route 313 and an electromagnetic valve 314.

In this embodiment, liquid in which water-soluble flocculants with a function of causing water-soluble color material to become insoluble or to be agglutinated is dissolved or dispersed in water or organic solvent is used as the treatment liquid 340.

Amount of the treatment liquid 340 in the supply pan 339 is detected by a liquid level detection sensor 338. When the treatment liquid 340 is consumed by repeated application processes and the liquid level of the treatment liquid 340 in the supply pan 339 becomes lower than a specified level, the electromagnetic valve 314 is opened, the pump 312 is driven, and the treatment liquid 340 in the cartridge 311 is supplied to the supply pan 339.

When the liquid level of the treatment liquid 340 in the supply pan 339 reaches the specified level, the electromagnetic valve 314 is closed based on a detection signal of the liquid level detection sensor 338, the pump 312 is stopped, and thus the amount of the treatment liquid 340 in the supply pan 339 is kept constant.

In this way, because the electromagnetic valve 314 opens only when supplying the treatment liquid 340 and operates for only a short period of time, the power consumption of the electromagnetic valve 314 and the running cost can be reduced by using a normal-closed type valve which is usually closed and is opened only when it is energized.

Next, the front surface treatment liquid application unit 230 is described. An eccentric cam 337 is in contact with the supply pan 339, thus the rotation of the eccentric cam 337 can cause a squeeze roller 331 to be pressed in the direction of an application roller 333.

The treatment liquid 340 stored in the supply pan 339 is drawn by the rotation of the squeeze roller 331 driven by a motor (not shown). Here, as for the squeeze roller 331, it is better to use a roller whose peripheral surface is grooved such as an Anilox roller or a wire bar. The reason is that there is an advantage in that the liquid drawing becomes less affected by the viscosity of the treatment liquid 340 or the print speed and thus the liquid amount control becomes easier.

Regarding the treatment liquid 340 drawn by the squeeze roller 331, an excess amount of which is scraped off by a metering blade 332 and a defined amount of which is carried to a nip portion between the squeeze roller 331 and the application roller 333. The treatment liquid 340 carried to the nip portion between the squeeze roller 331 and the application roller 333 is stretched evenly in the axis direction between the rollers 331 and 333 to become a thin film which is applied onto the application roller 333. The application roller 333 whose peripheral surface is covered with an elastic body such as a rubber is rotationally driven by a motor.

The treatment liquid 340 applied to the application roller 333 is applied to the recording medium W which is sandwiched and conveyed between the application roller 333 and a press roller 334.

The press roller 334 is rotationally freely supported via a swingingly movable arm 335. The press roller 334 rotates following the movement of the conveyed recording medium W. An eccentric cam 336 is in contact with the arm 335. As the eccentric cam 336 rotates, the press roller 334 is alternately pressed onto and separated from the application roller 333.

At the start of conveyance of the recording medium W, the application roller 333 performs a preparatory rotation in order to form a uniform-thickness liquid film of the treatment liquid 340 on the application roller 333. Specifically, a minimum number of rotation for a driving source which rotationally drives the application roller 333 is set and the application roller 333 is rotationally driven. With this preparatory rotation, before the start of the conveyance of the recording medium W, the uniform-thickness liquid film of the treatment liquid 340 is formed on the application roller 333.

It should be noted that the application roller 333 includes a one-way clutch mechanism (not shown). Also, after the start of the conveyance of the recording medium W, for the driving source which rotationally drives the application roller 333, a conveyance speed which is equal to or less than the conveyance speed set for a driving source of the conveyance roller 251 conveying the recording medium W is set.

The reason of the above is to cause, during the conveyance of the recording medium W, the application roller 333 to be rotated by the rotation of the conveyance roller 251 which conveys the recording medium W. By including the one-way clutch mechanism in the application roller 333 and by setting the conveyance speed of the conveyance roller 251 greater than or equal to the corresponding number of rotations of the application roller 333, the application roller 333 is caused to be rotated by rotation of the conveyance roller 251 which conveys the recording medium W.

It should be noted that the front surface treatment liquid application unit 230 includes an application unit move mechanism (not shown) for swinging each of the units of the front surface treatment liquid application unit 230 except for the press roller 334 in the width direction of the recording medium W. The application unit move mechanism is driven by a motor (not shown) and is able to cause each of the units of the front surface treatment liquid application unit 230 except for the press roller 334 to make a reciprocating motion within a predefined range in the width direction of the recording medium W.

4. Description of Slack of the Recording Medium which Occurs in the Treatment Liquid Application Apparatus 120

Next, the slack of the recording medium which occurs in the treatment liquid application apparatus 120 is described. In the treatment liquid application apparatus 120, at the stopping of conveyance, the number of rotations of the motor which rotationally drives the conveyance roller 251 reduces as the cycle interval of a conveyance synchronization signal transmitted from the inkjet printer 130*f* becomes longer. In the meantime, because of the characteristics of the motor which rotationally drives the conveyance roller 251, the rotation of the motor stops following the conveyance synchronization signal when frequency of the conveyance synchronization signal becomes less than a specified frequency. Therefore, when frequency of the conveyance synchronization signal becomes less than the specified frequency, in the treatment liquid application apparatus 120, a brake is applied to the motor which rotationally drives the conveyance roller 251 in order to stop the conveyance of the recording medium W.

At this time, on the conveyance path, the rolls without driving sources such as motors located in the upstream side of the conveyance roller 251 rotate due to the inertia. Therefore, the slack of the recording medium occurs in the upstream side of the conveyance roller 251.

Figure 4:
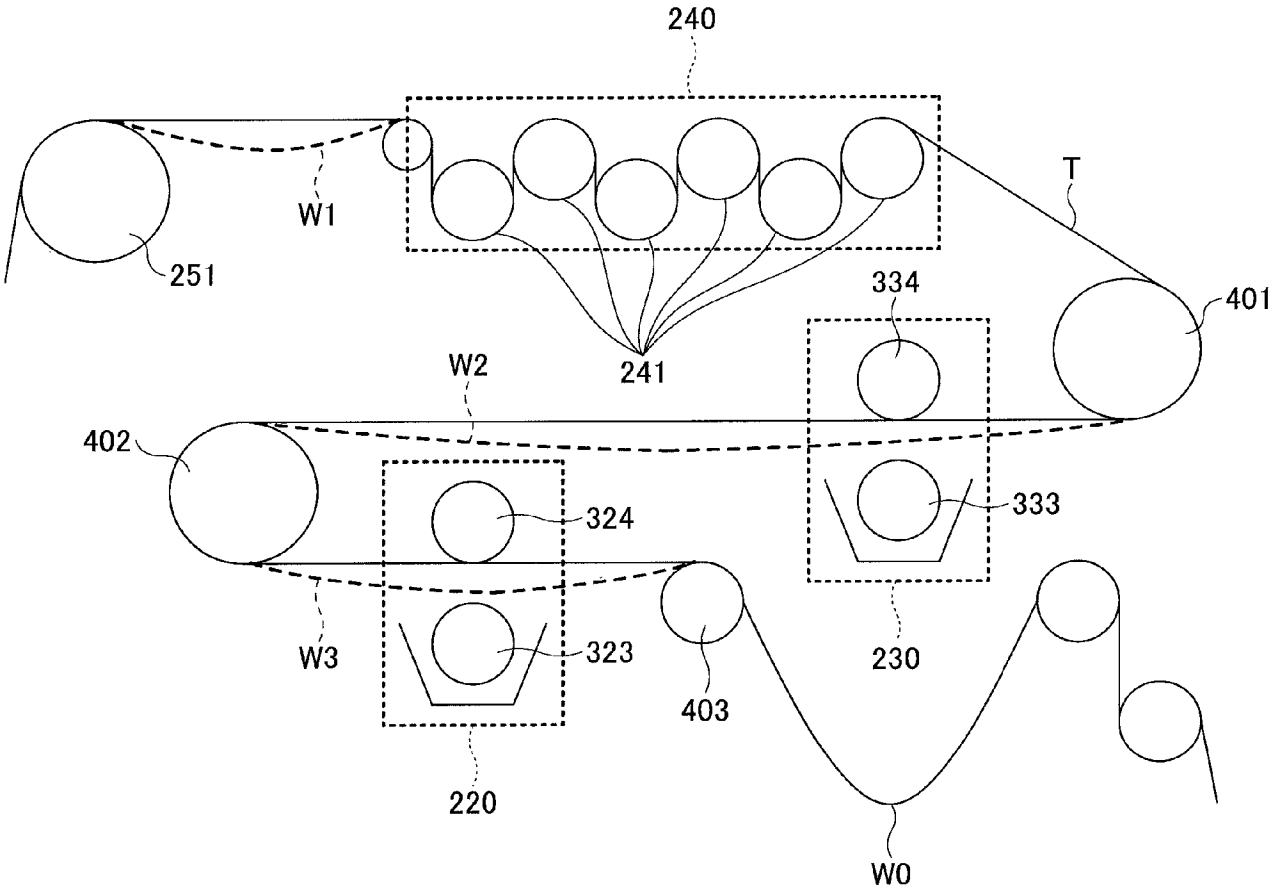
FIG. 4 is a drawing illustrating slack of the recording medium which occurs in the treatment liquid application apparatus according to an embodiment of the present invention.

FIG. 4 is a drawing illustrating slack of the recording medium W which occurs in a treatment liquid application apparatus 120. FIG. 4 is a schematic diagram showing that the recording medium W fed out from the paper feeding apparatus 110 into the treatment liquid application apparatus 120 passes along the air loop (AL), the rear surface treatment liquid application unit 220, the front surface treatment liquid application unit 230, the treatment liquid drying unit 240 and the conveyance roller 251.

In FIG. 4, the solid line W0 indicates a path when a predefined tension T is applied to the recording medium W in the treatment liquid application apparatus 120.

On the other hand, the dashed line W1 indicates a path in the case where slack of the recording medium W occurs between the conveyance roller 251 and the treatment liquid drying unit 240 at the stopping of conveyance. Also, the dashed line W2 indicates a path in the case where slack of the recording medium W occurs between a guide rollers 401 and 402. Furthermore, the dashed line W3 indicates a path in the case where slack of the recording medium W occurs between the guide rollers 402 and 403.

Here, in the case where it is assumed that, for the solid line W0, the slack amount of the dashed line W1 is M1, the slack amount of the dashed line W2 is M2 and the slack amount of the dashed line W3 is M2, the slack amount M of the recording medium W can be indicated by the following formula.

$$M=M1+M2+M3 \quad (1)$$

5. Method for Preventing a Failure Caused by Slack of the Recording Medium

Next, a method for preventing a failure occurring at the application roller at the time of resuming the conveyance due to the above slack of the recording medium W which occurs at the time of stopping the conveyance.

In the treatment liquid application apparatus 120 according to the present embodiment, in order to prevent a failure at the re-start of conveyance, the maximum slack amount of the recording medium W which occurs at the stopping of conveyance is calculated in advance. And, the treatment liquid application apparatus 120 includes a configuration in which, at the start of conveyance, after the recording medium W is conveyed for the conveyance amount corresponding to the maximum slack amount (that is, after the slack is removed), the press roller 334 is lowered and the recording medium W is pressed onto the application roller 333.

With the above configuration, the pressing of the recording medium W onto the application roller 333 is performed after the slack of the recording medium W is removed (that is, after the predetermined tension is applied to the recording medium W). As a result, a failure which occurs at the application roller due to the fact that the predetermined tension is not applied to the recording medium W can be prevented. In the following, referring to FIG. 5 and FIG. 6, the method for preventing the failure due to the slack of the recording medium W will be described.

Figure 5:
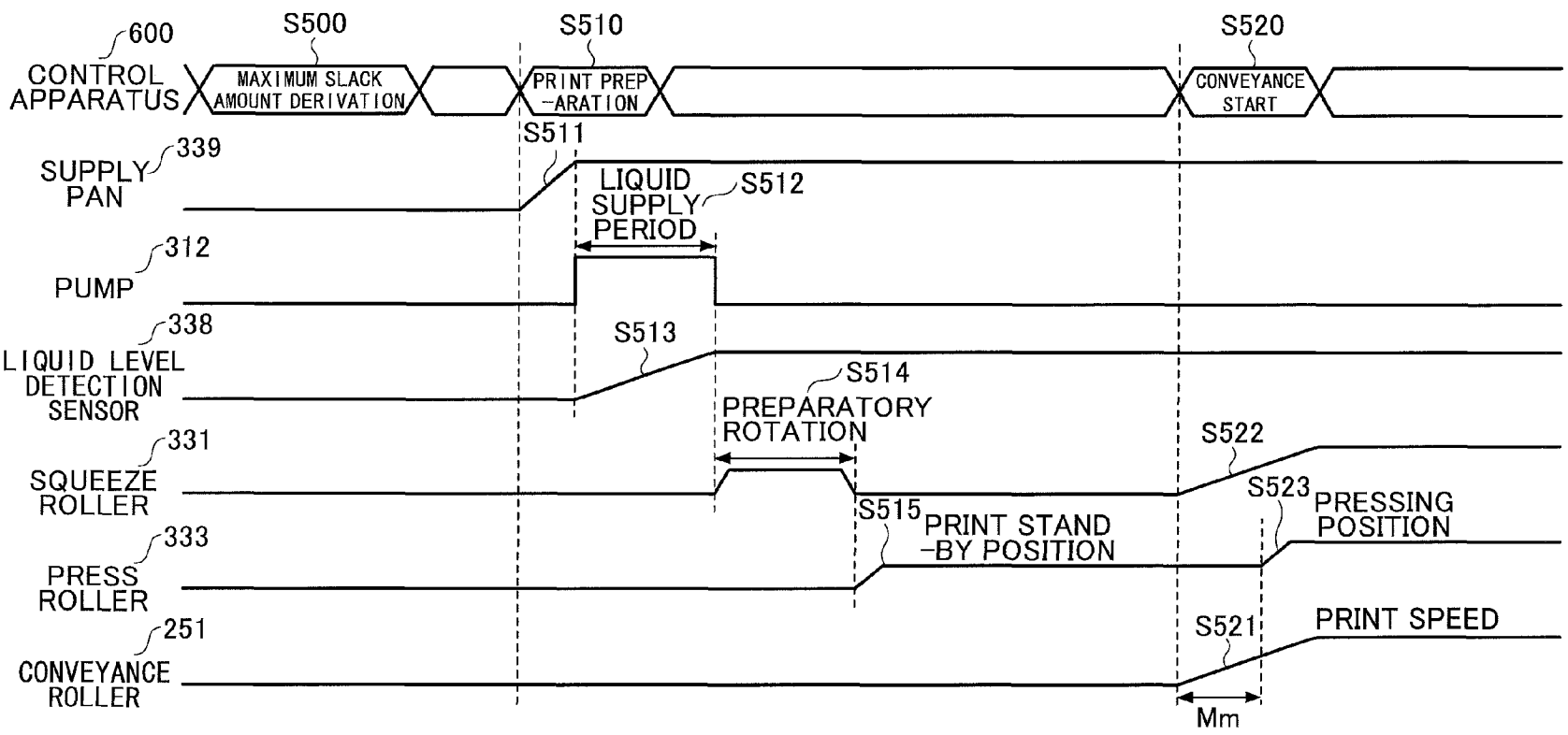
FIG. 5 is a timing chart illustrating a sequence of operations of each unit of the treatment liquid application apparatus according to an embodiment of the present invention.

FIG. 5 is a timing chart illustrating a sequence of operations from before the start of conveyance to after the start of conveyance of each unit of the treatment liquid application apparatus 120 according to the present embodiment which is capable of preventing a failure which occurs at the re-start of conveyance. As shown in FIG. 5, in the treatment liquid application apparatus 120, during the time before the start of conveyance, processes including a maximum slack amount derivation process (S500), a print preparation process (S510) and a conveyance start process (S520) are performed.

Figure 6:
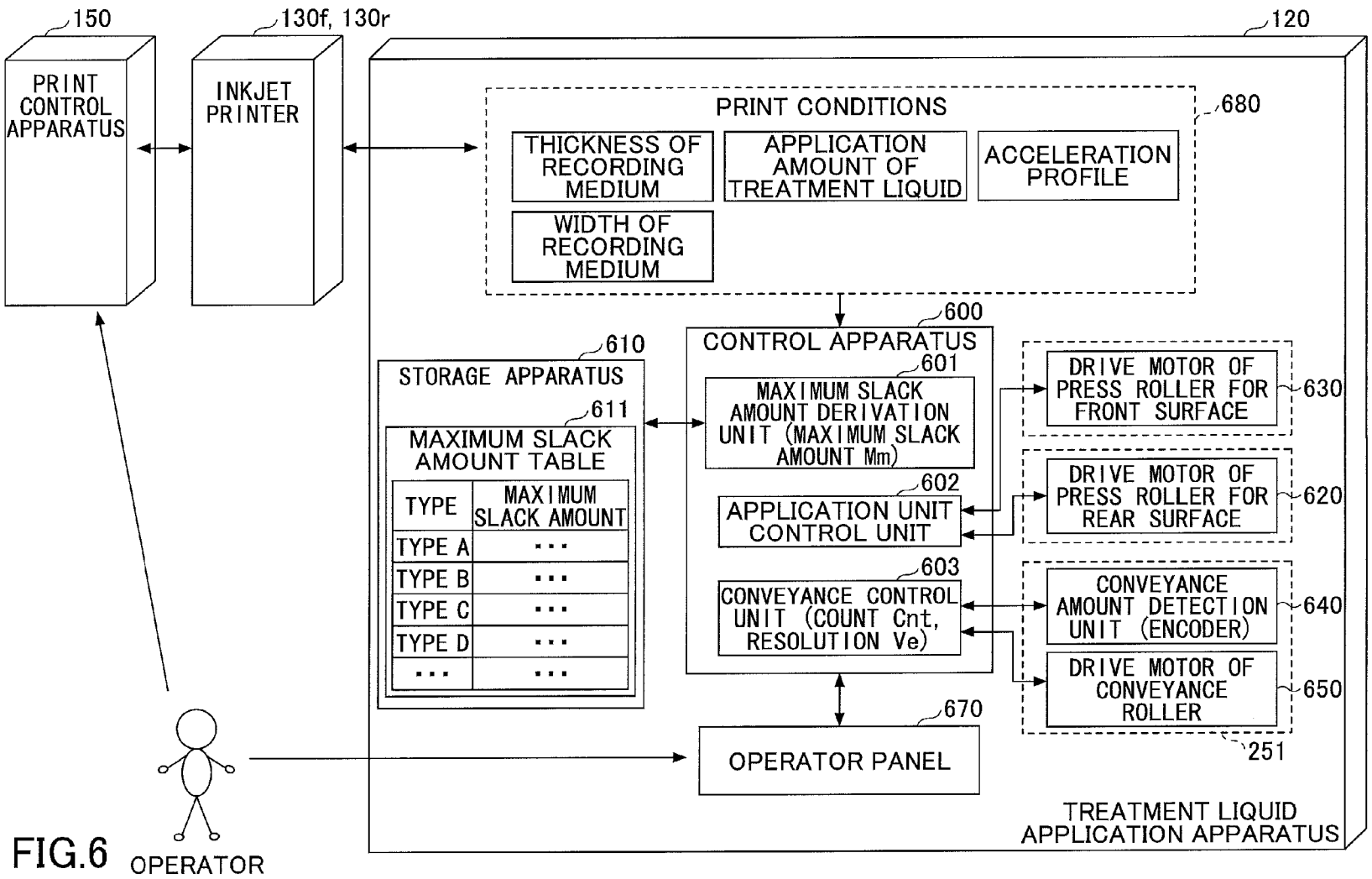
FIG. 6 is a drawing illustrating an example of a functional configuration of the treatment liquid application apparatus according to an embodiment of the present invention.

In the meantime, FIG. 6 is a drawing illustrating a functional configuration of a treatment liquid application apparatus 120 for performing the maximum slack amount derivation process (S500), the print preparation process (S510) and the conveyance start process (S520). In the following, referring to FIG. 6, the method for preventing a failure due to the slack of the recording medium will be described by explaining the time chart (overview of the maximum slack amount derivation process, the print preparation process and the conveyance start process) illustrated in FIG. 5.

(Overview of the Maximum Amount Derivation Process)

As shown in FIG. 5, before the start of conveyance of the recording medium W, the maximum slack amount derivation process (S500) is performed. The maximum slack amount derivation process (S500) is a process for deriving the maximum slack amount of the recording medium W which occurs at the stopping of conveyance in the treatment liquid application apparatus 120.

As shown in FIG. 6, the maximum slack amount derivation process is performed at a control apparatus 600 based on a "thickness of the recording medium", a "width of the recording medium" and a "amount of the treatment liquid" included in a print conditions 680 transmitted from the print control apparatus 150. It should be noted that the control apparatus 600 is a computer, which performs the maximum slack amount derivation process by executing a program functioning as a maximum slack amount deriving unit 601.

In the maximum slack amount deriving unit 601, based on the print conditions 680, the maximum slack amount Mm is derived by referring to a maximum slack amount table stored in a storage apparatus 610 in advance.

(Overview of the Print Preparation Process)

When the maximum slack amount derivation process is ended, subsequently, the print preparation process (S510) is performed at an application unit control unit 602 (a program functioning as the application unit control unit 602 is executed by the control apparatus 600). It should be noted that, here, only the print preparation process for the front surface treatment liquid application unit 230 is described. The print preparation process for the rear surface treatment liquid application unit 220 is basically the same.

As shown in FIG. 5, when the print preparation process is started by the application unit control unit 602, an application pan retractor motor (not shown) is rotationally driven causing the application pan 339 to move upward (S511). With this movement, the squeeze roller 331 presses the application roller 333 and the squeeze roller 331 is connected with the application roller 333 via a gear.

In the application unit control unit 602, a filling instruction is transmitted to the treatment liquid supply unit 210. In the treatment liquid supply unit 210, the filling of the supply pan 339 with the treatment liquid 340 is started.

Specifically, the pump 312 is driven, the treatment liquid 340 stored in the cartridge 311 is pumped up and the treatment liquid 340 is supplied to the supply pan 339 via the supply route 313 and the electromagnetic valve 314 (S512).

As the treatment liquid 340 is supplied to the supply pan 339, the output of the liquid level detection sensor 338 increases (S513). When the position of the liquid level reaches a specified height, the pump 312 stops driving (S512). When the supply of the treatment liquid 340 to the supply pan 339 is completed, for the cleaning of the application roller 333 and the forming of a liquid film, the squeeze roller 331 is rotationally driven for a specified time. With this rotational drive, the preparatory rotation is performed by the squeeze roller 331 and the application roller 333 (S514).

When the preparatory rotation is finished, in the application unit control unit 602, the motor for rotationally driving the press roller 334 is started and the press roller 334 is lowered to the print stand-by position (S515). With having the press roller 334 lowered to the print stand-by position, the print preparation process is completed.

(Overview of the Conveyance Start Process)

Next, an overview of the conveyance start process will be described. When the press roller 334 is lowered to the print stand-by position, the conveyance start process (S520) is performed at the conveyance control unit 603 (the control apparatus 600 executes a program functioning as the conveyance control unit 603).

Specifically, as the conveyance synchronization signal is output from the inkjet printer 130*f* based on an acceleration profile, a motor 650 for rotationally driving the conveyance roller 251 is started at the conveyance control unit 603 (S521). With the start of the motor 650, synchronizing with the conveyance synchronization signal, the conveyance of the recording medium W is started. Also, at the application unit control unit 602, the squeeze roller 331 is operated based on the acceleration profile (S522).

Here, as shown in FIG. 6, in the conveyance roller 251, a conveyance amount detection unit (encoder) 640 is installed. At the conveyance control unit 603, based on the output of the conveyance amount detection unit (encoder) 640, the conveyance amount after the start of the conveyance of the recording medium W is calculated. It should be noted that the conveyance amount detection unit installed in the conveyance roller 251 is not limited to an encoder.

At the conveyance control unit 603, it is monitored whether the conveyance amount after the start of conveyance exceeds the maximum slack amount Mm which has already been derived in the maximum slack amount derivation process (S500). In the case where it is determined at the conveyance control unit 603 that the conveyance amount after the start of conveyance exceeds the maximum slack amount Mm, at the application unit control unit 602, a driving motor 630 for lowering the press roller 334 for the front surface is operated (S523). Also, a driving motor 620 for lowering a press roller for the rear surface is operated. With the driving motors 620 and 630, the recording medium W is pressed onto each of the application rollers (the application roller 333 for the front surface and the application roller for the rear surface).

As a result, the pressing of the recording medium W onto the application rollers (the application roller 333 for the front surface and the application roller for the rear surface) is performed after the slack of the recording medium W is removed (that is, after the predetermined tension is applied to the recording medium W). In this way, a failure occurring at the application rollers (the application roller 333 for the front surface and the application roller for the rear surface) due to the fact that the predetermined tension is not applied to the recording medium W can be prevented.

It should be noted that, in the following, of all the above processes, the maximum slack derivation process (S500) and the conveyance start process (S520) will be further described.

6. Detailed Description of the Maximum Slack Amount Derivation Process

The detailed description of the maximum slack amount derivation process will be described.

<6.1 Method of Determining Slack Amount>

First, a method of determining slack amount is described. As the maximum slack amount Mm of the recording medium W varies depending on the types of the recording medium W or the application amount of the treatment liquid, in the present embodiment, the slack amount is determined based on the empirical values obtained from experiments and the maximum slack amount is derived from the determined slack amount.

In order to determine the slack amount of the recording medium W based on the empirical values obtained from experiments, various types of the recording media W with different thicknesses and widths are prepared and conveyance start and stop operations are repeated for each of the various types of the recording media W. And, by measuring the slack amounts at the stopping of conveyance, the maximum slack amount for each type of the recording media W (maximum value of M1+M2+M3) is determined.

In the treatment liquid application apparatus 120 according to the present embodiment, a maximum slack amount table 611 in which each types of the recording media W is associated with the maximum slack amount is created in advance and stored in the storage apparatus 610.

It should be noted that regarding another slack measurement method, the following procedure, for example, can be considered. First, the conveyance is started from a state in which the slack of the recording medium W has occurred when the conveyance of the recording medium W is stopped. Then, the conveyance is continued until a predetermined tension is applied to the recording medium W. Here, the slack amount is calculated by counting the number of pulses output from the conveyance amount detection unit (encoder) 640 during the time between the start of conveyance and the time when the predetermined tension is applied. It should be noted that with this kind of procedure, the conveyance amount of the recording medium W for removing the slack (conveyance amount corresponding to the slack) can be directly calculated.

Also, regarding yet another slack measurement method, the following procedure, for example, can be considered. First, multiple sensors such as distance measuring sensors are arranged in the lower side of the location where the slack occurs. Furthermore, the profile of the recording medium W is calculated by measuring the distance from each of the sensors to the recording medium W when the conveyance of the recording medium W is stopped. And, the slack amount is calculated by calculating the difference between the length of the profile and the length of the straight line connecting the end points of the profile. With this kind of procedure, the slack amount of the recording medium W can be directly calculated.

It should be noted that the slack amount measuring method is not limited to the above, and the slack amount may be measured by other measuring methods.

<6.2 Flow of the Maximum Slack Amount Derivation Process>

Figure 7:
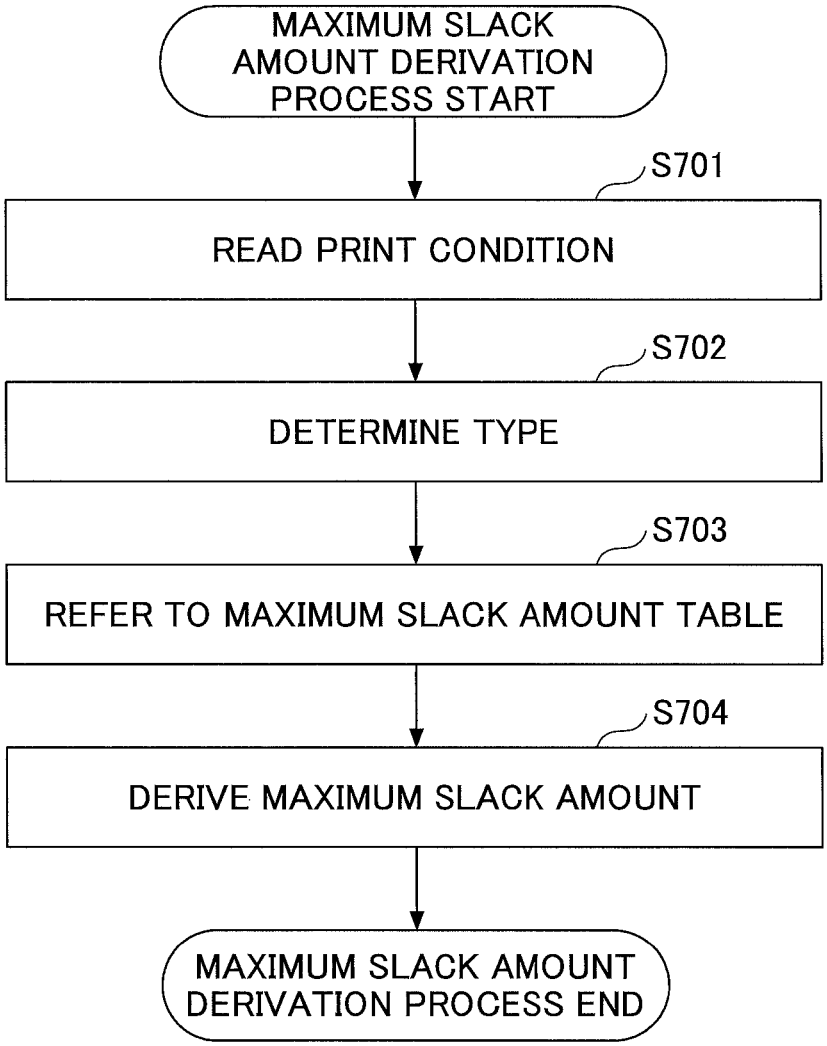
FIG. 7 is a flowchart illustrating a flow of a maximum amount of slack derivation process of the treatment liquid application apparatus according to an embodiment of the present invention.

Next, the flow of the maximum slack amount derivation process (S500) will be described. FIG. 7 is a flowchart illustrating the flow of the maximum amount of slack Mm derivation process in the treatment liquid application apparatus 120. In step S701, the maximum slack amount deriving unit 601 reads the "thickness of the recording medium", the "width of the recording medium" and the "amount of the treatment liquid" included in the print conditions 680 transmitted from the print control apparatus 150.

In step S702, the maximum slack amount deriving unit 601 determines the type of the maximum slack amount based on the print conditions 680 read in step S701. In step S703, the maximum slack amount deriving unit 601 refers to the maximum slack amount table 611. In step S704, the maximum slack amount deriving unit 601 derives a slack amount corresponding to the type determined in step S702 as the maximum slack amount Mm. With above steps S702 through S704, the maximum slack amount Mm according to the print conditions 680 is derived.

It should be noted that the method of deriving the maximum slack amount Mm is not limited to the above. For example, the largest of all maximum slack amounts determined for each of the types (that is, the maximum slack amount regardless the type) may be configured to be derived as the maximum slack amount Mm.

It is needless to say that the unit of slack amount may be an inch or a meter, or any other unit.

7. Detailed Description of the Conveyance Start Process

Next, the detailed description of the conveyance start process (S520) will be described.

<7.1 Relationship Between an Acceleration Profile and the Conveyance Amount>

Figure 8:
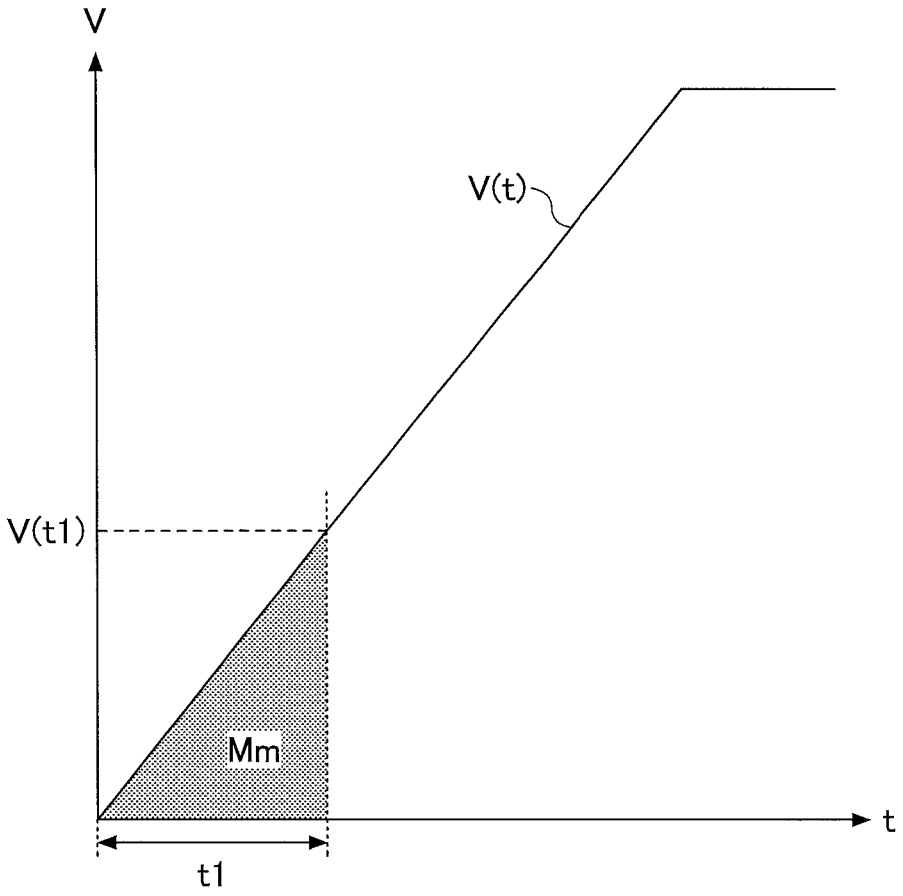
FIG. 8 is a drawing illustrating a relationship between an acceleration profile and a conveyance amount.

First, a relationship between an acceleration profile and the conveyance amount is described. FIG. 8 is a drawing illustrating the relationship between the acceleration profile and the conveyance amount.

In FIG. 8, the solid line V(t) indicates the acceleration profile of the recording medium W (the relationship between the elapsed time t and the corresponding conveyance speed).

Therefore, the hatched area surrounded by the solid line V(t) and the horizontal axis (in other words, the value obtained by the time integral of the conveyance speed) indicates the conveyance amount after the start of the conveyance.

Here, when the hatched area is equal to the maximum slack amount Mm of the recording medium W, the following equation holds.

$$Mm=\int_0^{t1} V(t)dt \quad (2)$$

Here, time t1 indicates the time needed for conveying a conveyance amount corresponding to the maximum slack amount Mm with the acceleration profile V(t).

Here, in the case of the acceleration profile V(t) in the present embodiment, as shown in FIG. 8, it is assumed that the acceleration from the start of the conveyance of the recording medium W to the time when each of the conveyance speeds is reached is constant regardless the conveyance speed. In this case, when the conveyance speed at the time of t1 is V(t1), the formula 2 can be simplified to the following formula.

$$Mm=V(t1)*t1*½ \quad (3)$$

In other words, by deriving the maximum slack amount Mm and obtaining the acceleration profile V(t), the time needed for conveying the conveyance amount corresponding to the maximum slack amount Mm (reference time t1) and the conveyance speed at the time (reference conveyance speed V(t1)) can be calculated.

<7.2 Method for Monitoring Whether the Conveyance Amount Exceeds the Maximum Slack Amount Mm>

Next, a method for monitoring whether the conveyance amount after the start of conveyance exceeds the maximum slack amount Mm will be described. As described above, in order to remove the maximum slack amount Mm of the recording medium W, it is necessary to convey the conveyance amount corresponding to the maximum slack amount Mm. Here, when the conveyance amount necessary for removing the maximum slack amount Mm is a reference conveyance amount Pm, the maximum slack amount Mm of the formula 3 can be replaced by the reference conveyance amount Pm.

$$Pm=V(t1)*t1*½ \quad (4)$$

It should be noted that by dividing the reference conveyance amount Pm with the resolution Ve of the conveyance amount detection unit (encoder) 640, the reference encoder count value Cnt corresponding to the reference conveyance amount Pm can be calculated.

$$\text{Cnt}=Pm/Ve \quad (5)$$

From the above, in order to monitor whether the conveyance amount after the start of conveyance exceeds the maximum slack amount Mm, the following monitoring methods, for example, can be considered.

A method in which a conveyance amount is calculated based on the output of the conveyance amount detection unit (encoder) 640 and it is monitored whether the conveyance amount after the start of conveyance exceeds the reference conveyance amount Pm A method in which a conveyance speed is calculated based on the output of the conveyance amount detection unit (encoder) 640 and it is monitored whether the conveyance speed of the conveyance roller 251 exceeds the reference conveyance speed V(t1)

A method in which an elapsed time from the start of the output of the conveyance amount detection unit (encoder) 640 is measured and it is monitored whether the elapsed time exceeds the reference time t1

A method in which a number of output pulses of the conveyance amount detection unit (encoder) 640 is counted and it is monitored whether the number exceeds the reference encoder count value Cnt.

It is common in any of the above monitoring methods that, by monitoring a value related to the conveyance amount from the start of conveyance with respect to a value corresponding to the maximum slack amount Mm, the press roller is controlled to be lowered when the value related to the conveyance amount from the start of conveyance exceeds the value corresponding to the maximum slack amount Mm. Here, it should be noted that the value corresponding to the maximum slack amount Mm includes the reference conveyance amount Pm, the reference conveyance speed V(t1), the reference time t1 and the reference encoder count value Cnt. Also, the value related to the conveyance amount from the start of conveyance includes the conveyance amount, the conveyance speed, the time and the encoder count value.

It should be noted that the unit of conveyance amount may be an inch or a meter, or any other unit.

<7.3 Flow of Conveyance Start Process>

Figure 9:
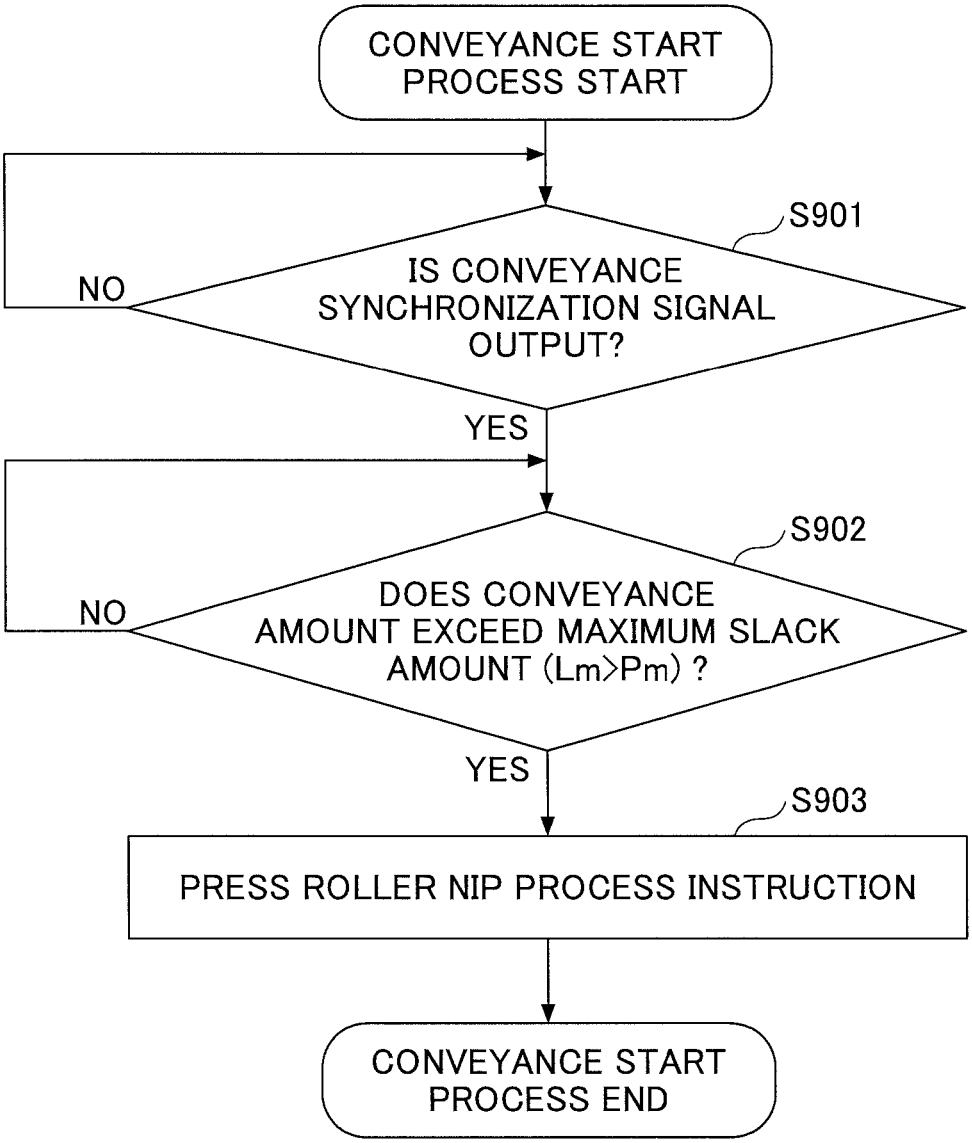
FIG. 9 is a flowchart illustrating a flow of a conveyance start process of the treatment liquid application apparatus according to an embodiment of the present invention.

Next, the conveyance start process flow will be described. FIG. 9 is a flowchart illustrating a flow of the conveyance start process by the conveyance control unit 603. When the print preparation process is completed by having the press roller 334 for the front surface and the press roller for the rear surface lowered to the print stand-by position, the conveyance start process shown in FIG. 9 is performed.

In step S901, it is determined whether the conveyance synchronization signal is output from the inkjet printer 130*f*. In the case where it is determined that the conveyance synchronization signal is not output, it is determined that the conveyance has not been started and the flow waits for the start.

On the other hand, in the case where it is determined that the conveyance synchronization signal is output in step S901 (YES for S901), the flow proceeds to step S902 and starts conveyance of the recording medium W by causing the conveyance roller 251 to be rotationally driven synchronizing with the conveyance synchronization signal. Then, it is determined whether the conveyance amount Lm of the recording medium W after the start of conveyance exceeds the reference conveyance amount Pm corresponding to the maximum slack amount Mm.

In step S902, in the case where it is determined that the conveyance amount Lm of the recording medium W does not exceed the reference conveyance amount Pm corresponding to the maximum slack amount Mm (NO for S902), the flow waits until it is determined that the conveyance amount Lm exceeds the reference conveyance amount Pm. On the other hand, in the case where it is determined that the conveyance amount Lm of the recording medium W exceeds the reference conveyance amount Pm corresponding to the maximum slack amount Mm in step S902 (YES for S902), the flow proceeds to step S903. In step S903, the press roller 334 for the front surface and the press roller for the rear surface are lowered so that the recording medium W is pressed onto the application roller 333 for the front surface or the application roller for the rear surface.

In this way, in the treatment liquid application apparatus 120 according to the present embodiment, upon determining that the conveyance synchronization signal is output, it is determined that the conveyance has just started and the conveyance control unit 603 monitors the conveyance amount Lm of the recording medium W due to the conveyance roller 251. And when the conveyance amount Lm of the recording medium W after the start of conveyance due to the conveyance roller 251 exceeds the reference conveyance amount Pm corresponding to the maximum slack amount Mm, the press roller 334 for the front surface and the press roller for the rear surface are lowered. With having the press rollers lowered, the recording medium W is pressed onto the application roller 333 for the front surface and the application roller for the rear surface.

In other words, it is after the recording medium W is conveyed as much as the reference conveyance amount Pm corresponding to the maximum slack amount Mm of the recording medium W that the recording medium W is pressed onto the application roller 333 for the front surface and the application roller for the rear surface. As a result, the recording medium W is pressed onto the application roller 333 for the front surface and the application roller for the rear surface when the recording medium W is in a state in which the predetermined tension is applied to the recording medium W. With the above configuration, the recording medium W can be prevented from getting rolled around the application roller 333 for the front surface and the application roller for the rear surface.

It should be noted that although in the above description, the conveyance amount Lm calculated based on the output of the conveyance amount detection unit (encoder) 640 is configured to be monitored, the present invention is not limited to this configuration and it may be the conveyance speed or the elapsed time from the start of conveyance that are configured to be monitored.

8. Summary

As is clear from the above description, in the treatment liquid application apparatus 120 according to the present embodiment includes:

a configuration in which an amount of slack which occurs at the stopping of conveyance is obtained experimentally for each of the types of the recording media and the amount of slack is stored in a storage apparatus as a maximum slack amount table;

a configuration in which the type of the recording medium is determined based on the print conditions obtained before the start of conveyance, the maximum slack amount is derived;

a configuration in which the conveyance amount of the recording medium after the start of conveyance is monitored based on the derived maximum slack amount; and a configuration in which in the case where the conveyance amount of the recording medium after the start of conveyance exceeds the conveyance amount corresponding to the derived maximum slack amount, the press roller is lowered and the recording medium is pressed onto the application roller.

With this arrangement, the treatment liquid application apparatus 120 according to the present embodiment can remove the slack of the recording medium which has occurred at the stopping of conveyance, thereby pressing the recording medium onto the application roller only after the predetermined tension is applied to the recording medium.

In other words, a failure which occurs at the application roller because the recording medium is pressed onto the application roller when the predetermined tension has not yet been applied to the recording medium can be prevented.

The Second Embodiment

The above first embodiment, in the conveyance start process, includes a configuration in which the conveyance amount from the start of conveyance is monitored, and in the case where the conveyance amount exceeds the reference conveyance amount Pm corresponding to the maximum slack amount Mm, the recording medium W is pressed onto the application roller 333 for the front surface and the application roller for the rear surface (FIG. 9). Also, the above first embodiment includes a configuration in which the start of conveyance is determined based on the conveyance synchronization signal from the inkjet printer 130*f*. The present invention is not limited to this configuration.

For example, included may be a configuration in which the number of pulses output from the conveyance amount detection unit (encoder) 640 is monitored and the start of conveyance is determined by the detection of the output pulse. Also, included may be a configuration in which in the case where the number of pulses output from the conveyance amount detection unit (encoder) 640 exceeds the reference encoder count value Cnt, the recording medium W is pressed onto the application roller 333 for the front surface or the application roller for the rear surface. In the following, referring to FIG. 10, the flow of the conveyance start process in the present embodiment will be described.

Figure 10:
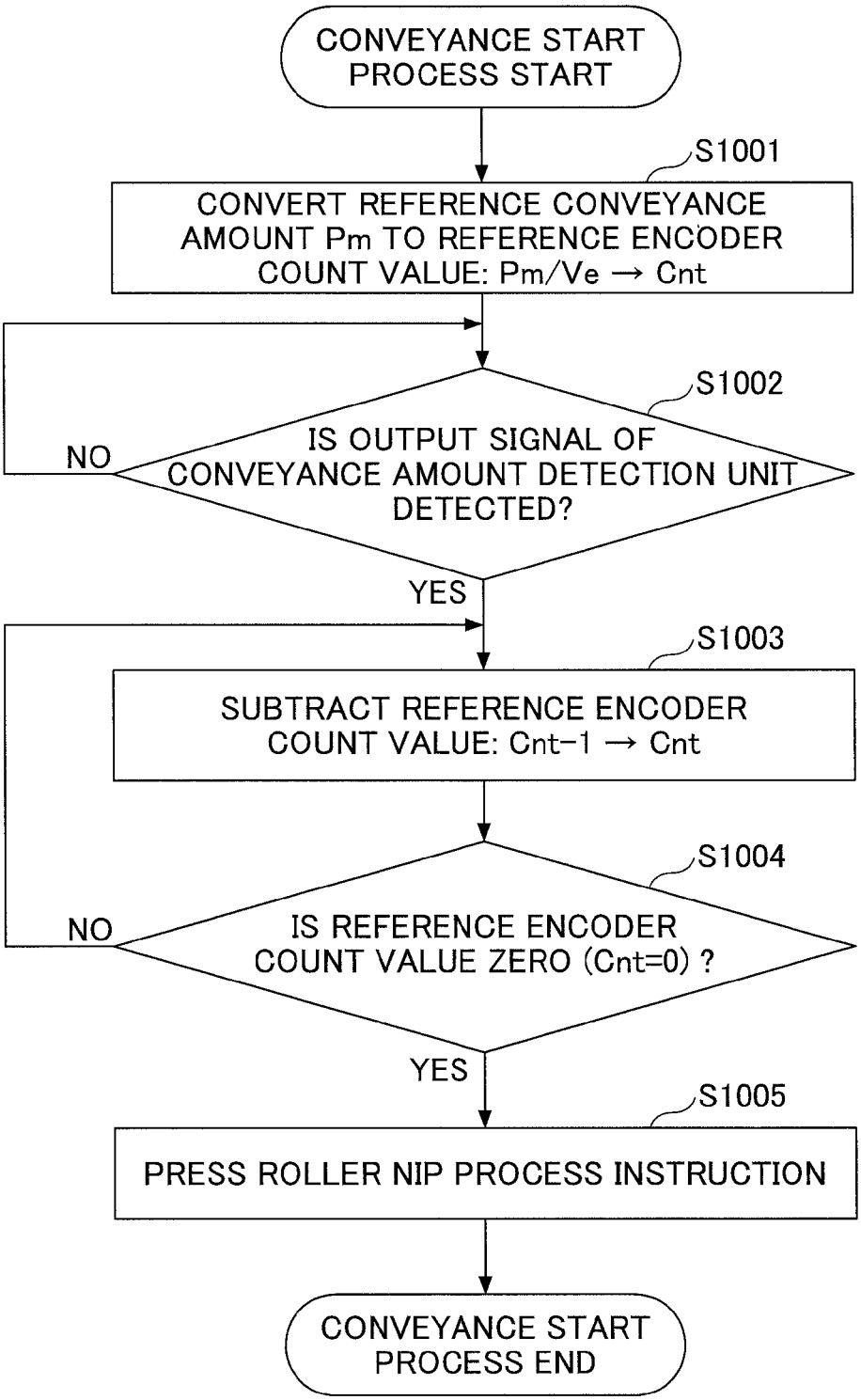
FIG. 10 is a flowchart illustrating an other flow of the conveyance start process of the treatment liquid application apparatus according to an embodiment of the present invention.

FIG. 10 is a flowchart illustrating a flow of a conveyance start process of the treatment liquid application apparatus 120 according to the present embodiment. In step S1001, the reference conveyance amount Pm is converted to the count value (reference encoder count value) of the output pulses of the conveyance amount detection unit (encoder) 640.

Specifically, as shown in formula 5, the reference encoder count value Cnt corresponding to the reference conveyance amount Pm is obtained by Cnt=Pm/Ve.

In step S1002, it is determined whether the output pulse of the conveyance amount detection unit (encoder) 640 is detected. In the case where it is determined that the output pulse is not detected, as it can be determined that the conveyance roller 251 is not rotationally driven, the flow waits for the start of the rotational drive of the conveyance roller 251.

On the other hand, in the case where it is determined that the output pulse is detected in step S1002 (YES for S1002), the flow proceeds to step S1003. In step S1003, the reference encoder count value Cnt is decremented every time an output pulse is output from the conveyance amount detection unit (encoder) 640.

In step S1004, it is determined whether the reference encoder count value Cnt becomes zero. In step S1004, in the case where it is determined that the reference encoder count value Cnt has not become zero (NO for S1004), the flow returns to step S1003. And the process in which the reference encoder count value Cnt is decremented every time an output pulse is output from the conveyance amount detection unit (encoder) 640 is continued.

On the other hand, in the case where it is determined that the reference encoder count value Cnt becomes zero (YES for S1004), it is determined that the recording medium W is conveyed as much as the conveyance amount Pm corresponding to the maximum slack amount Mm, and the flow proceeds to step S1005.

In step S1005, the application unit control unit 602 is instructed to perform a NIP process of the press roller 334 for the front surface and the press roller for the rear surface, and the conveyance start process is finished. It should be noted that the NIP process of the press roller 334 for the front surface and the press roller for the rear surface is a process in which the press roller 334 for the front surface and the press roller for the rear surface are lowered so that the recording medium W is pressed onto the application roller 333 for the front surface and the application roller for the rear surface, respectively.

As is clear from the above description, the present embodiment includes a configuration in which the output pulse of the conveyance amount detection unit (encoder) 640 is monitored, and in the case where the number of output pulses exceeds the reference encoder count value Cnt, the recording medium W is pressed onto the application roller 333 for the front surface and the application roller for the rear surface. The same effect as the above first embodiment can be obtained in this case.

The Third Embodiment

The above second embodiment includes a configuration in which the timing for the recording medium W to be pressed onto the application roller 333 for the front surface and the application roller for the rear surface is decided by determining whether the number of output pulses of the conveyance amount detection unit (encoder) 640 exceeds the reference encoder count value Cnt. The present invention, however, is not limited to this configuration.

Even if the lowering of the press roller for the front surface and the press roller for the rear surface is started right after the number of output pulses of the conveyance amount detection unit (encoder) 640 exceeds the reference encoder count value Cnt, there is a predetermined time lag before the recording medium W is actually pressed onto the application roller 333 for the front surface and the application roller for the rear surface.

Therefore, in this embodiment, considering such a time lag, the recording medium W is controlled to be actually pressed onto the application roller 333 for the front surface and the application roller for the rear surface at the timing just when the number of output pulses of the conveyance amount detection unit (encoder) 640 exceeds the reference encoder count value Cnt corresponding to the reference conveyance amount Pm. In the following, referring to FIG. 11, the flow of the conveyance start process in the present embodiment will be described.

Figure 11:
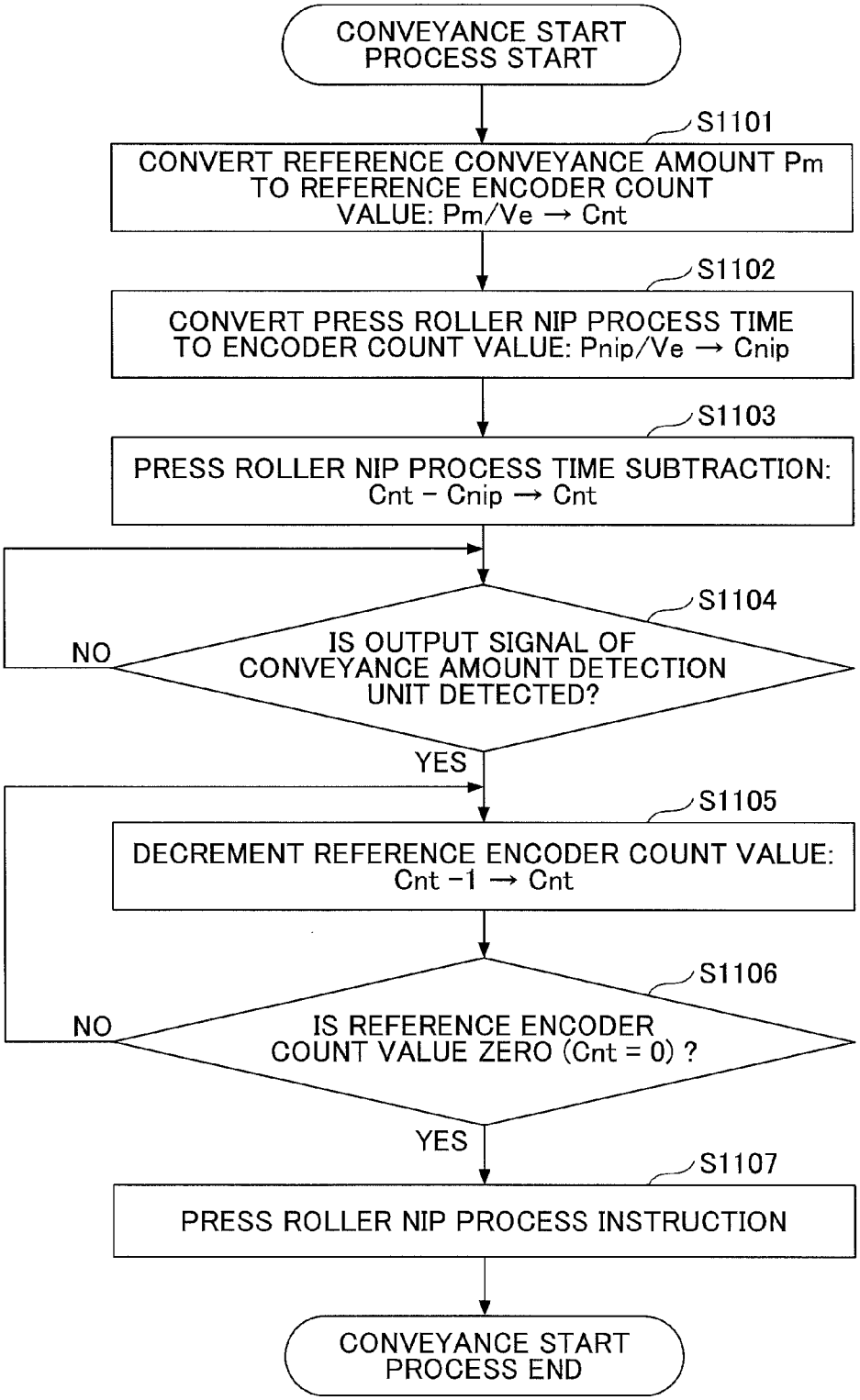
FIG. 11 is a flowchart illustrating an other flow of the conveyance start process of the treatment liquid application apparatus according to an embodiment of the present invention.

FIG. 11 is a flowchart illustrating the flow of the conveyance start process according to the present embodiment. In step S1101, the reference conveyance amount Pm is converted to the count value (reference encoder count value) of the output pulses of the conveyance amount detection unit (encoder) 640.

Specifically, as shown in formula 5, the reference encoder count value Cnt corresponding to the reference conveyance amount Pm is obtained by Cnt=Pm/Ve.

In step S1102, an encoder count value of the output pulses of the conveyance amount detection unit (encoder) 640 corresponding to the time necessary for the NIP process of the press rollers for the front and rear surfaces is calculated.

Specifically, when it is assumed that the time necessary for the NIP process of the press rollers for the front and rear surfaces is Tnip, the conveyance amount Pnip which is the conveyance amount the recording medium W is conveyed during Tnip is calculated by Pnip=V(Tnip)*Tnip*½. Therefore, the encoder count value Cnip corresponding to the conveyance amount Pnip can be calculated by calculating Pnip by using Tnip and acceleration profile V(t), and dividing the conveyance amount Pnip with the resolution Ve of the conveyance amount detection unit (encoder) 640.

In step S1103, a new reference encoder count value Cnt is calculated by subtracting the encoder count value Cnip calculated in step S1102 from the reference encoder count value Cnt calculated in step S1101.

In step S1104, it is determined whether the output pulse of the conveyance amount detection unit (encoder) 640 is detected. In the case where it is determined that the output pulse of the conveyance amount detection unit (encoder) 640 is not detected (NO for S1104), it can be determined that the conveyance roller 251 is not rotationally driven, and the flow waits for the start of the rotational drive of the conveyance roller 251.

On the other hand, in the case where it is determined that the output pulse of the conveyance amount detection unit (encoder) 640 is detected (YES for S1104), the flow proceeds to step S1105. In step S1105, the reference encoder count value Cnt is decremented every time an output pulse is output from the conveyance amount detection unit (encoder) 640.

In step S1106, it is determined whether the reference encoder count value Cnt becomes zero. In the case where, in step S1106, it is determined that the reference encoder count value Cnt has not become zero yet (NO for S1106), the flow returns to step S1105. And the process in which the reference encoder count value Cnt is decremented every time an output pulse is output from the conveyance amount detection unit (encoder) 640 is continued.

On the other hand, in the case where, in step S1106, it is determined that the reference encoder count value Cnt has become zero (YES for S1106), it is determined that the recording medium W is conveyed as much as the conveyance amount Pm (in which conveyance amount corresponding to the time necessary for the NIP process of the press rollers is subtracted) corresponding to the maximum slack amount Mm.

In step S1107, the application unit control unit 602 is instructed to perform a NIP process of the press roller 334 for the front surface and the press roller for the rear surface, and the conveyance start process is finished.

As is clear from the above description, the present embodiment includes a configuration in which the reference encoder count value Cnt is calculated by taking into account the time necessary for the NIP process of the press roller 334 for the front surface and the press roller for the rear surface.

With the above configuration, the recording medium W can be put in a state in which the recording medium W is pressed onto the application roller 333 for the front surface and the application roller for the rear surface at the timing just when the recording medium W is conveyed as much as the conveyance amount Pm corresponding to the maximum slack amount Mm.

The Fourth Embodiment

The above third embodiment includes a configuration in which the start timing of the NIP process of the press roller 334 of the front surface treatment liquid application unit 230 is the same as the start timing of the NIP process of the press roller of the rear surface treatment liquid application unit 220. The present invention is not limited to this configuration.

For example, a configuration in which the start timing of the NIP process of the press roller 334 of the front surface treatment liquid application unit 230 and the start timing of the NIP process of the press roller of the rear surface treatment liquid application unit 220 are controlled individually may be included. In the following, referring to FIG. 12, the flow of the conveyance start process in the present embodiment will be described.

Figure 12:
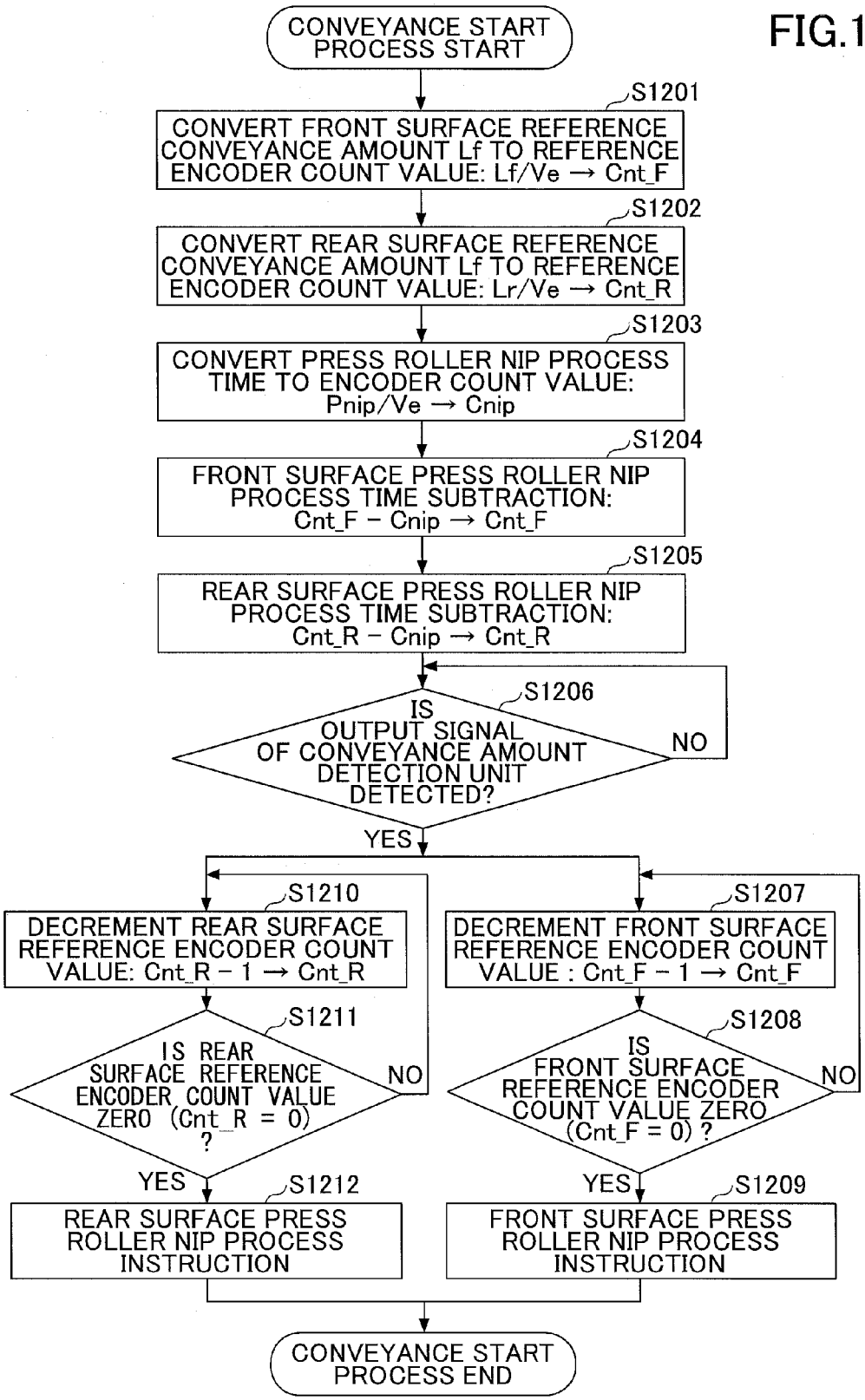
FIG. 12 is a flowchart illustrating an other flow of the conveyance start process of the treatment liquid application apparatus according to an embodiment of the present invention.

FIG. 12 is a flowchart illustrating the flow of the conveyance start process according to the present embodiment. In step S1201, a front surface reference conveyance amount Lf is converted to the count value (front surface reference encoder count value) of the output pulses of the conveyance amount detection unit (encoder) 640. It should be noted that the front surface reference conveyance amount Lf is, of slack amounts M1 through M3 which constitute the maximum slack amount Mm, a conveyance amount corresponding to the maximum value of M1+M2. The front surface reference encoder count value Cnt_F is obtained by Cnt_F=Lf/Ve.

In step S1202, a rear surface reference conveyance amount Lr is converted to the count value (rear surface reference encoder count value) of the output pulses of the conveyance amount detection unit (encoder) 640. It should be noted that the rear surface reference conveyance amount Lr is, of slack amounts M1 through M3 which constitute the maximum slack amount Mm, a conveyance amount corresponding to the maximum value of M1+M2+M3 (that is, Mm). The rear surface reference encoder count value Cnt_R is obtained by Cnt_R=Lr/Ve.

In step S1203, the encoder count value of the output pulses of the conveyance amount detection unit (encoder) 640 corresponding to the time necessary for the NIP process of the press rollers is calculated.

Specifically, when it is assumed that the time necessary for the NIP process of the press rollers is Tnip, the conveyance amount Pnip, which is a conveyance amount of the recording medium W which is conveyed during the time Tnip, is calculated by Pnip=V(Tnip)*Tnip*½. Therefore, by calculating Pnip using Tnip and the acceleration profile V(t), and dividing the conveyance amount Pnip with the resolution Ve of the conveyance amount detection unit (encoder) 640, the encoder count value Cnip corresponding to the conveyance amount Pnip can be calculated. It should be noted that the common value may be used for both the encoder count value Cnip for front surface and the encoder count value Cnip for rear surface or the encoder count value Cnip for front surface and the encoder count value Cnip for rear surface may be individually calculated.

In step S1204, the encoder count value Cnip calculated in step S1203 is subtracted from the reference encoder count value for front surface Cnt_F calculated in step S1201. With this subtraction, a new reference encoder count value for front surface Cnt_F is calculated.

In step S1205, the encoder count value Cnip calculated in step S1203 is subtracted from the reference encoder count value for rear surface Cnt_R calculated in step S1202. With this subtraction, a new reference encoder count value for rear surface Cnt_R is calculated.

In step S1206, it is determined whether the output pulse of the conveyance amount detection unit (encoder) 640 is detected. In the case where the output pulse is not detected (NO for S1206), it can be determined that the conveyance roller 251 is not rotationally driven so that the flow waits for the start of rotational drive of the conveyance roller 251.

On the other hand, in the case where it is determined that the output pulse is detected in step S1206 (YES for S1206), the flow proceeds to step S1207. In step S1207, the reference encoder count value for front surface Cnt_F is decremented every time an output pulse is output from the conveyance amount detection unit (encoder) 640.

In step S1208, it is determined whether the reference encoder count value for front surface Cnt_F becomes zero. In step S1208, in the case where the reference encoder count value for front surface Cnt_F has not become zero (NO for S1208), the flow returns to step S1207. And, the process in which the reference encoder count value for front surface Cnt_F is decremented every time an output pulse is output from the conveyance amount detection unit (encoder) 640 is continued.

On the other hand, in the case where it is determined that the reference encoder count value for front surface Cnt_F becomes zero in step S1208 (YES for S1208), it is determined that the recording medium W is conveyed as much as the reference conveyance amount Pm (in which the conveyance amount corresponding to the time necessary for the NIP process of the press roller is subtracted).

In step S1209, the application unit control unit 602 is instructed to perform a NIP process of the press roller 334 for the front surface (process of lowering the press roller 334 for the front surface and pressing the recording medium W onto the application roller 333 for the front surface).

Similarly, in the case where it is determined that the output pulse is detected in step S1206 (YES for S1206), the flow proceeds to step S1210. In step S1210, the reference encoder count value for rear surface Cnt_R is decremented every time an output pulse is output from the conveyance amount detection unit (encoder) 640.

In step S1211, it is determined whether the reference encoder count value for rear surface Cnt_R becomes zero. In step S1211, in the case where the reference encoder count value for rear surface Cnt_R has not become zero, the flow returns to step S1210. And, the process in which the reference encoder count value for rear surface Cnt_R is decremented every time an output pulse is output from the conveyance amount detection unit (encoder) 640 is continued.

On the other hand, in the case where it is determined that the reference encoder count value for rear surface Cnt_R becomes zero in step S1211 (YES for S1211), it is determined that the recording medium W is conveyed as much as the reference conveyance amount Pm (in which the conveyance amount corresponding to the time necessary for the NIP process of the press roller is subtracted).

In step S1212, the application unit control unit 602 is instructed to perform a NIP process of the press roller for the rear surface (process of lowering the press roller for the rear surface and pressing the recording medium W onto the application roller for the rear surface).

As is clear from the above description, in the present embodiment, the start timing of the NIP process of the press roller 334 of the front surface treatment liquid application unit 230 and the start timing of the NIP process of the press roller of the rear surface treatment liquid application unit 220 are configured to be controlled individually.

With this configuration, the NIP processes of the press rollers can be performed at the more appropriate timing in each of the treatment liquid application units for the front surface and the rear surface.

The Fifth Embodiment

The above first through fourth embodiments include a configuration in which in order to derive the maximum slack amount Mm, it is automatically derived by referring to the maximum slack amount table based on the print conditions. The present invention is not limited to this configuration.

For example, a configuration in which, based on the print condition received from the print control apparatus 150, an operator directly inputs the maximum slack amount through an operator panel may be included.

It should be noted that the present invention is not limited to the configurations listed in the above embodiments. The configurations listed in the above embodiments may be combined with other elements.

Further, the present invention is not limited to these embodiments, and various variations and modifications may be made without departing from the scope of the present invention.

The present application is based on and claims the benefit of priority of Japanese Priority Application No. 2013-146911 filed on Jul. 12, 2013, the entire contents of which are hereby incorporated by reference.

What is claimed is:

1. A treatment liquid application apparatus comprising:

a first application roller configured to apply treatment liquid;

a first press roller configured to press against the first application roller an elongated recording medium which is placed between the first press roller and the first application roller;

a conveyance roller located downstream relative to the first application roller on a conveyance path of the recording medium and configured to convey the recording medium;

an obtaining unit configured to obtain a first slack amount of the recording medium which is created on an upstream side of the conveyance roller at a stopping of conveyance of the recording medium by the conveyance roller;

a conveyance amount calculation unit configured to calculate a value related to a conveyance amount of the recording medium conveyed by the conveyance roller from a re-start of conveyance;

a detection unit configured to detect that the value related to the conveyance amount from the re-start of conveyance of the recording medium calculated by the conveyance amount calculation unit exceeds a first value corresponding to the first slack amount of the recording medium; and a control unit configured to cause the first press roller to be pressed against the first application roller when the detection unit detects that the value related to the conveyance amount of the recording medium exceeds the first value corresponding to the first slack amount of the recording medium.

2. The treatment liquid application apparatus as claimed in claim 1 further comprising an operation time calculation unit configured to calculate an operation time from when the first press roller starts a first operation for moving towards the first application roller to when the recording medium is pressed against the application roller, wherein a value corresponding to the operation time is excluded from the first value corresponding to the first slack amount of the recording medium, and the control unit causes the first press roller to start the first operation when the detection unit detects that the value related to the conveyance amount exceeds the first value corresponding to the first slack amount of the recording medium.

3. The treatment liquid application apparatus as claimed in claim 2 wherein the first application roller and the first press roller for applying treatment liquid to a first surface of the recording medium are arranged at a first location on the conveyance path and a second application roller and a second press roller for applying treatment liquid to a second surface of the recording medium are arranged at a second location different from the first location on the conveyance path, wherein the first value corresponding to the first slack amount of the recording medium is defined according to the first location of the first application roller and a second value corresponding to a second slack amount of the recording medium is defined according to the second location of the second application roller, and wherein the value corresponding to the operation time is excluded from the second value corresponding to the second slack amount of the recording medium.

4. The treatment liquid application apparatus as claimed in claim 3 wherein upon detection by the detection unit that the value related to the conveyance value from the re-start of conveyance exceeds the first value corresponding to the first slack amount of the recording medium, the control unit causes the first press roller to start the first operation for moving toward the first application roller, and wherein upon detection by the detection unit that the value related to the conveyance value from the re-start of conveyance exceeds the second value corresponding to the second slack amount of the recording medium, the control unit causes the second press roller to start a second operation of moving toward the second application roller.

5. The treatment liquid application apparatus as claimed in claim 1 further comprising a setting unit configured to set the first slack amount of the recording medium, wherein the obtaining unit obtains the first slack amount of the recording medium set by the setting unit.

6. The treatment liquid application apparatus as claimed in claim 1 further comprising a storage unit configured to store a table in which each type of the recording medium is associated with a corresponding slack amount, wherein the obtaining unit, at the re-start of conveyance, obtains the slack amount of the recording medium by determining the type of the recording medium and reading the corresponding slack amount from the table.

* * * * *